US009480325B2

(12) United States Patent
Hall

(10) Patent No.: US 9,480,325 B2
(45) **Date of Patent: *Nov. 1, 2016**

(54) BACKPACK THAT CONVERTS TO A SLEEPING MAT

(71) Applicant: Claudia Patricia Hall, Bellingham, WA (US)

(72) Inventor: Claudia Patricia Hall, Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/869,500

(22) Filed: Sep. 29, 2015

(65) Prior Publication Data

US 2016/0015158 A1 Jan. 21, 2016

Related U.S. Application Data

(63) Continuation of application No. 14/297,575, filed on Jun. 5, 2014, now Pat. No. 9,144,290.

(51) Int. Cl.

| | |
|---|---|
| ***A45F 4/04*** | (2006.01) |
| ***A45F 4/02*** | (2006.01) |
| ***A45F 4/00*** | (2006.01) |
| ***A45C 15/00*** | (2006.01) |
| ***A45F 4/06*** | (2006.01) |
| ***A45F 3/08*** | (2006.01) |

(52) U.S. Cl.

CPC ..... *A45F 4/06* (2013.01); *A45C 15/00* (2013.01); *A45F 3/08* (2013.01); *A45F 4/00* (2013.01); *A45F 2004/003* (2013.01)

(58) Field of Classification Search

CPC ..... A45F 4/06; A45F 3/08; A45F 5/02; A45F 5/021; A45F 3/04; A45C 15/00

USPC ..... 224/156, 154, 155, 575, 576

See application file for complete search history.

(56) References Cited

U.S. PATENT DOCUMENTS

| | | | | |
|---|---|---|---|---|
| 33,385 | A | 10/1861 | Fordsham et al. | |
| 3,045,261 | A * | 7/1962 | Hocherman | A45F 4/06 190/2 |
| 5,649,658 | A * | 7/1997 | Hoffman | A45F 3/04 190/2 |
| 5,785,219 | A * | 7/1998 | Kraft | A45F 4/02 2/66 |
| 6,952,845 | B1 * | 10/2005 | Akkad | A45F 4/02 383/4 |
| 7,058,997 | B1 * | 6/2006 | Klinger | A47G 9/086 190/18 A |
| 8,118,201 | B1 * | 2/2012 | Calkin | A45F 3/047 224/156 |
| 8,490,230 | B2 * | 7/2013 | Rovin | A47D 5/006 190/2 |
| 2003/0135925 | A1 * | 7/2003 | Higashi | A45C 3/10 5/417 |
| 2013/0228600 | A1 * | 9/2013 | Teixeira | A47G 9/086 224/156 |

* cited by examiner

*Primary Examiner* — Justin Larson
*Assistant Examiner* — Lester L Vanterpool
(74) *Attorney, Agent, or Firm* — Michael R. Schacht; Schacht Law Office, Inc.

(57) ABSTRACT

A travel backpack comprises a main portion defining a main chamber for storing items, a mat portion, and a main pad. The main pad is supported by the main portion and the mat portion such that the main pad extends through at least a portion of the main portion and through the mat portion. The travel backpack is arranged in a first configuration and a second configuration. In the first configuration, the mat portion is folded and secured to the main portion to facilitate carrying of the travel backpack. In the second configuration, the mat portion is unfolded to allow the travel backpack to be used as a sleep surface, where the main pad extends along the length of the sleep surface when the travel backpack is in the second configuration.

14 Claims, 12 Drawing Sheets

BACKPACK THAT CONVERTS TO A SLEEPING MAT

RELATED APPLICATIONS

This application, U.S. patent application Ser. No. 14/869,500 filed Sep. 29, 2015, is a continuation of U.S. patent application Ser. No. 14/297,575, filed Jun. 5, 2014, now U.S. Pat. No. 9,144,290, which issued on Sep. 29, 2015.

U.S. patent application Ser. No. 14/297,575 claims benefit of U.S. Provisional Application Ser. No. 61/960,862 filed Sep. 30, 2013, the contents of which are incorporated herein by reference.

TECHNICAL FIELD

The present invention relates to backpacks and, more particularly, to multi-function backpacks that function both to carry and store items and as a sleeping mat.

BACKGROUND

Travelers typically carry travel items such as clothing, shoes, documents, computers, and the like. Bags, luggage, backpacks, and the like are typically used to facilitate the movement of such travel items. The present invention is of particular significance when applied to backpacks designed for airplane travel, and that application of the present invention will be described herein in detail. However, the principles of the present invention may be applied to other types of backpacks, such as backpacks designed for camping.

Travel backpacks are typically designed to be slung over one shoulder or both shoulders of the traveler to allow the traveler to carry travel items in a hands free fashion. Travel backpacks also are designed with handles to allow the backpack to be carried like a suitcase.

The need exists for improved travel backpacks that provide the traveler with additional flexibility and comfort when confronted by travel delays, long layovers, and the like.

SUMMARY

The present invention may be embodied as a travel backpack comprising a main portion defining a main chamber for storing items, a mat portion, and a main pad. The main pad is supported by the main portion and the mat portion such that the main pad extends through at least a portion of the main portion and through the mat portion. The travel backpack is arranged in a first configuration and a second configuration. In the first configuration, the mat portion is folded and secured to the main portion to facilitate carrying of the travel backpack. In the second configuration, the mat portion is unfolded to allow the travel backpack to be used as a sleep surface, where the main pad extends along the length of the sleep surface when the travel backpack is in the second configuration.

The present invention may also be embodied as a method of providing a travel backpack comprising the following steps. A main portion defining a main chamber for storing items is provided. A mat portion is secured to the main portion at a juncture. A main pad is secured to the main portion and the mat portion such that the main pad extends across the juncture. The mat portion is folded and the mat portion is secured to the main portion to arrange the travel backpack in a first configuration to facilitate carrying of the travel backpack. The mat portion is unfolded to arrange the travel backpack in a second configuration to allow the travel backpack to be used as a sleep surface, where the main pad extends along the length of the sleep surface when the travel backpack is in the second configuration.

DETAILED DESCRIPTION

FIGS. 1-12 illustrate a first example travel backpack 20 constructed in accordance with, and embodying, the principles of the present invention. The first example travel backpack 20 defines a main portion 22 and a mat portion 24. A main pad 26 forms part of the mat portion 24.

Figure 2:
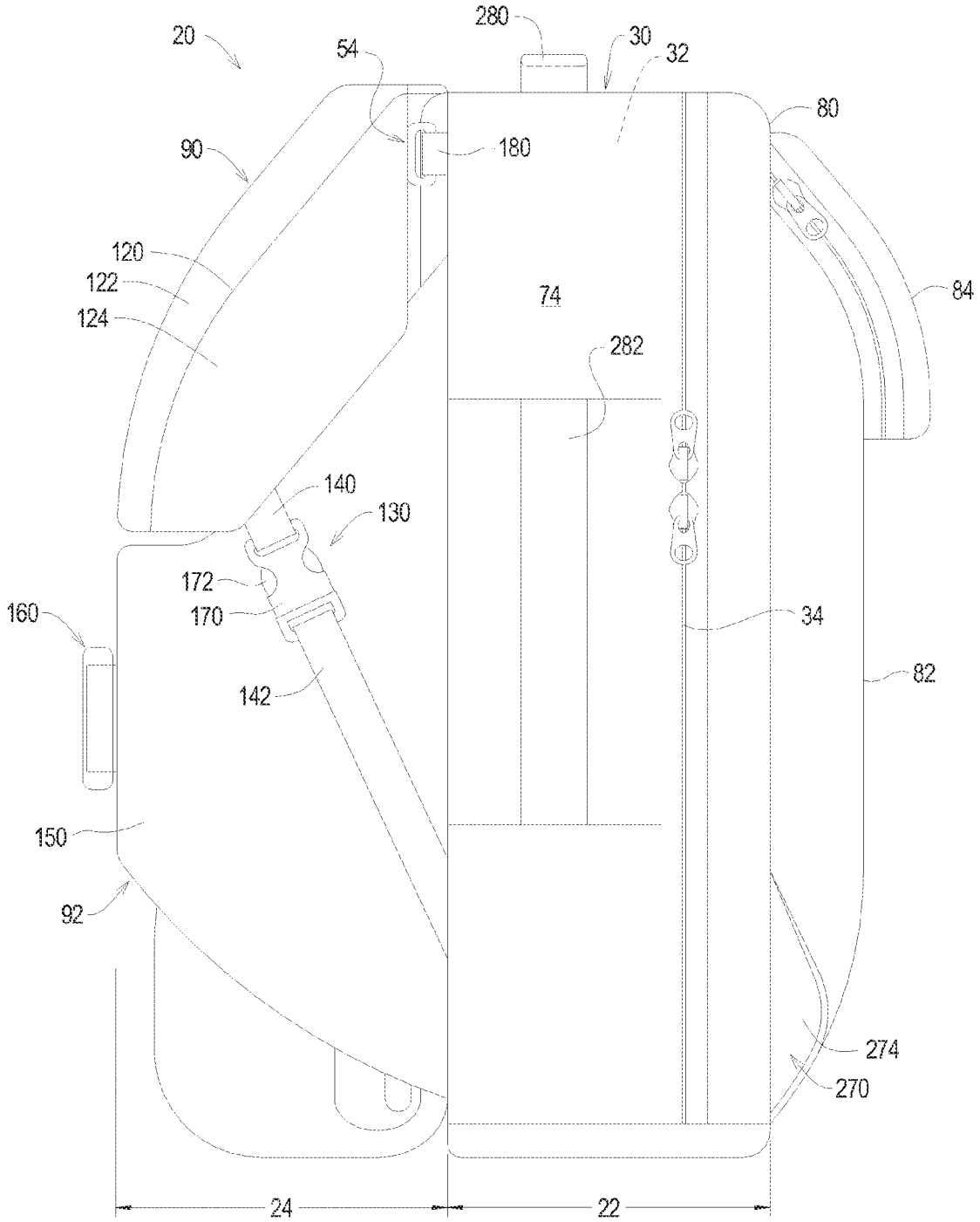
FIG. 2 is a side elevation view of the first example travel backpack in the first configuration.
Figure 3:
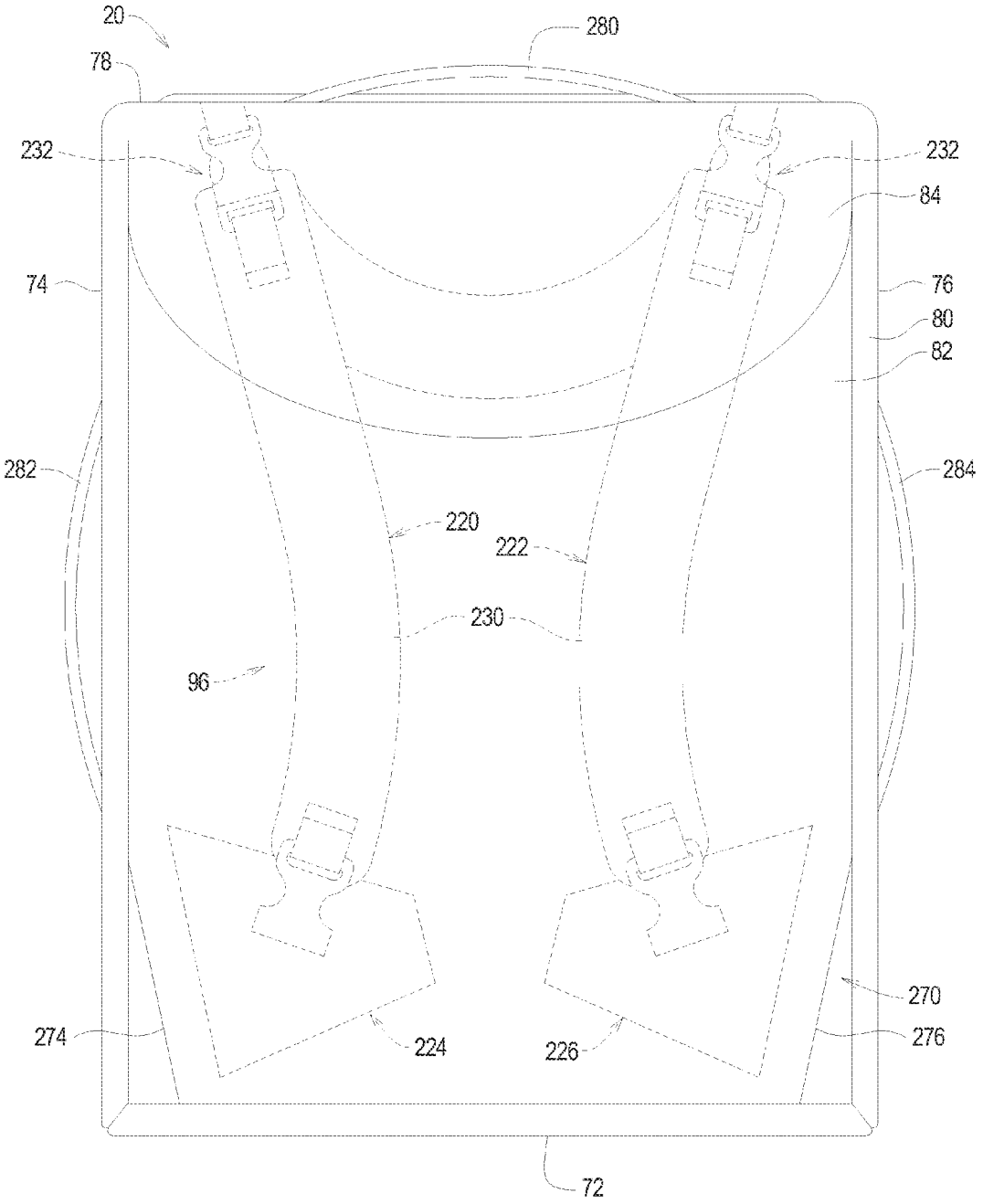
FIG. 3 is a front elevation view of the first example travel backpack in the first configuration.
Figure 4:
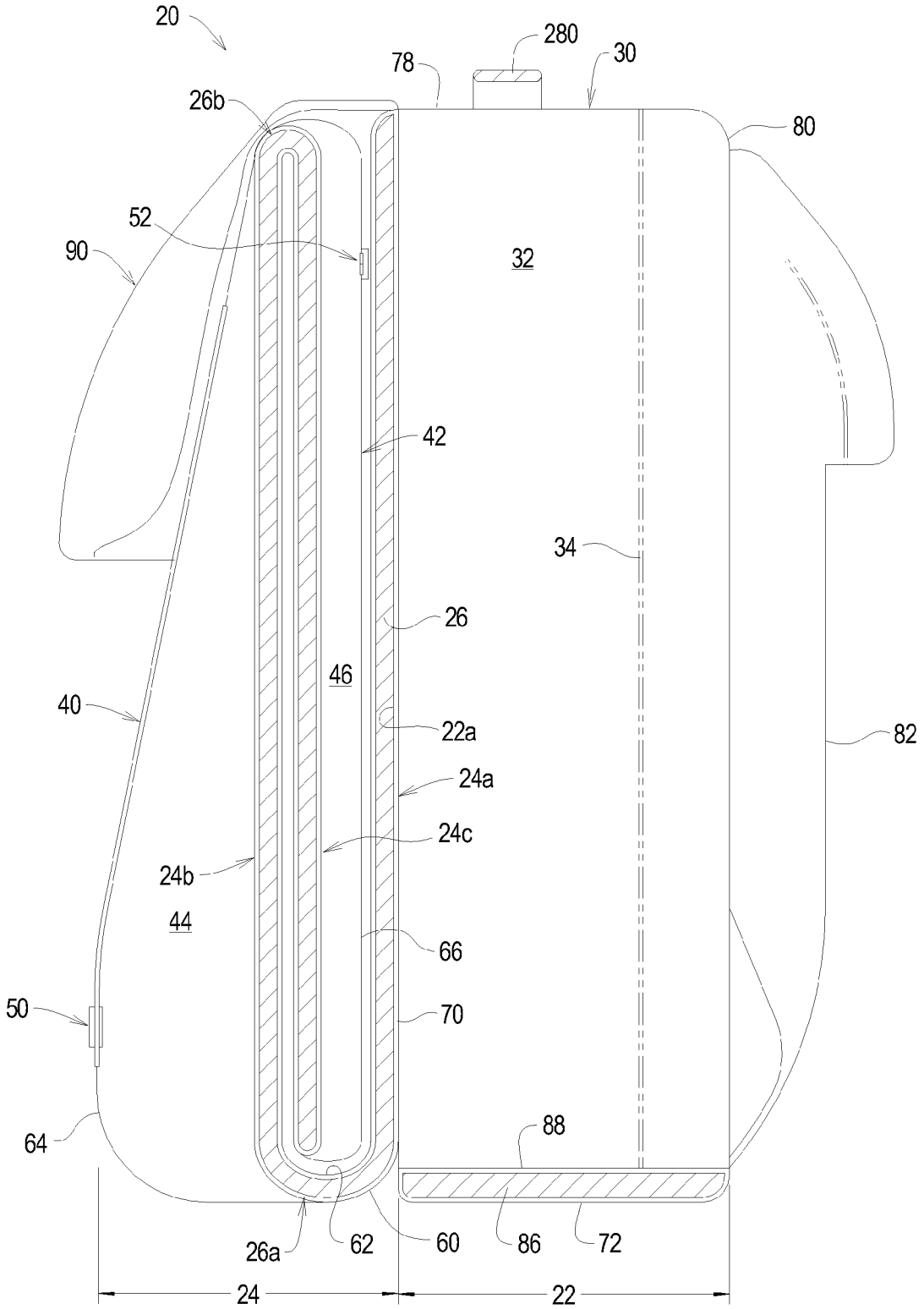
FIG. 4 is a somewhat schematic, section view of the first example travel backpack.
Figure 8:
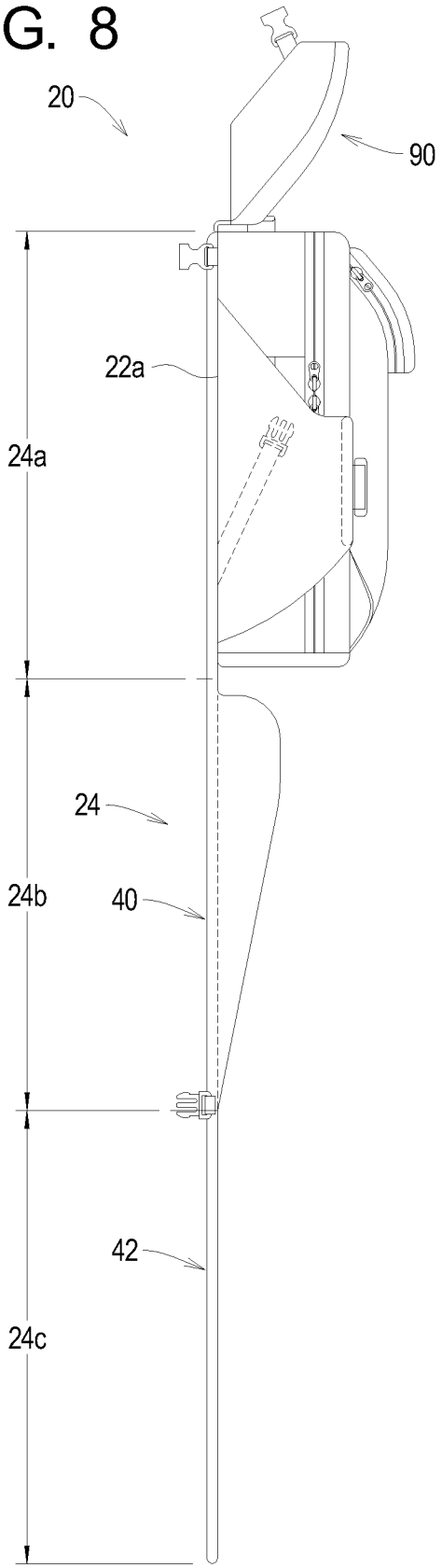
FIG. 8 is a side elevation view of part of a third step of the process of converting the first example travel backpack from the first configuration to the second configuration.
Figure 9:
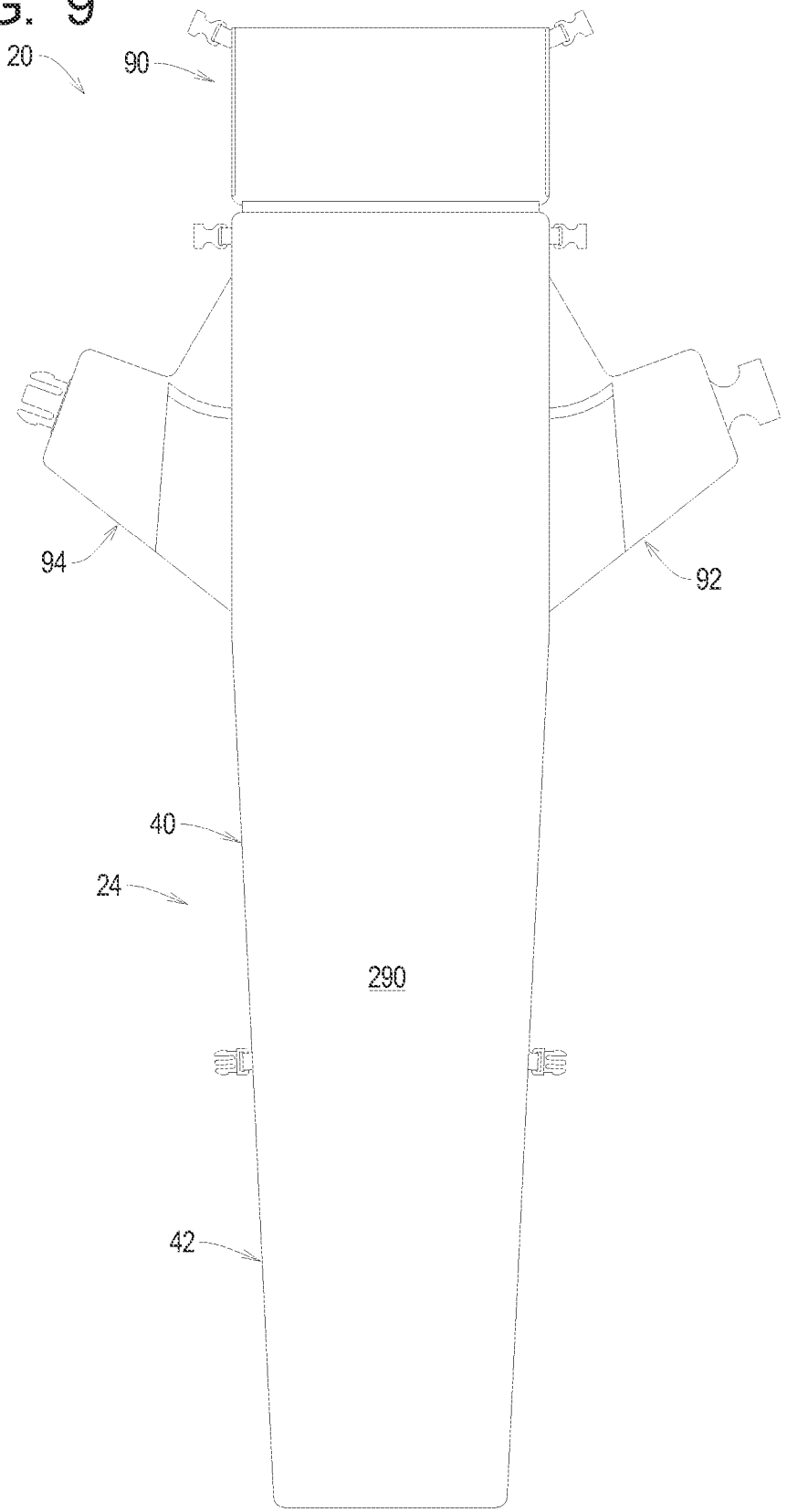
FIG. 9 is a rear elevation view of the part of the process depicted in FIG. 8.
Figure 10:
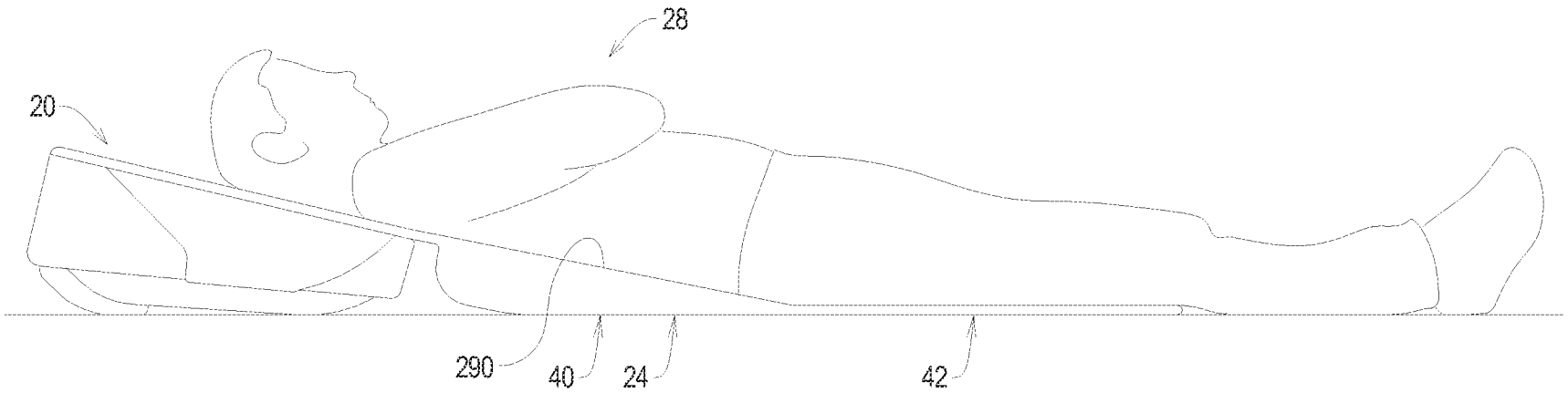
FIG. 10 is a side elevation view depicting the use of the first example backpack in the second configuration.

The first example travel backpack 20 may be used in a first configuration as depicted in FIGS. 1-4 or in a second configuration as depicted in FIGS. 8-10. In the first configuration, the first example travel backpack 20 may be used in a conventional manner to carry and store travel items. In the first example travel back pack 20, the mat portion 24 comprises a first section 24*a*, a second section 24*b*, and a third section 24*c* as perhaps best shown in FIGS. 4 and 8. FIG. 4 illustrates that, in the first configuration, the mat portion 24 is folded such that the first, second, and third sections 24*a*, 24*b*, and 24*c* thereof are substantially parallel to and spaced from each other. FIG. 8 illustrates that, in the second configuration, the mat portion 24 is unfolded such that the first, second, and third sections 24*a*, 24*b*, and 24*c* thereof are substantially coplanar. Further, the mat portion 24 is secured to the main portion 22 such that, in both the first and second configurations, the first section 24*a* of the mat portion 24 overlies a rear surface 22*a* of the main portion 22.

As shown in FIGS. 2 and 4, the example main portion 22 comprises a main structure 30 defining a main chamber 32. The main portion 22 further comprises a main zipper 34 for selectively allowing or preventing access to the main portion chamber 32. As shown in FIGS. 4 and 6-9, the example mat portion 24 comprises first and second mat structures 40 and 42 defining first and second mat chambers 44 and 46, respectively. The example mat portion 24 further comprises first and second mat zippers 50 and 52 for selectively allowing or preventing access to the first and second mat chambers 44 and 46, respectively. The example travel backpack 20 further comprises first and second mat fastener assemblies 54 and 56 to allow the mat portion 24 to be detachably attached to the main portion 22 and thus secure the first example travel backpack 20 in the first configuration.

FIG. 10 illustrates that, when the first example travel backpack 20 is in the second configuration, the first example travel backpack 20 may be used as a sleeping mat by a traveler 28. The example main pad 26 is a compressible foam sheet that provides cushioning for the traveler 28. Alternatively, the main pad 26 may comprise an air mattress that is deflated to reduce bulk when the first example travel backpack 20 is in the first configuration and inflated to provide cushioning when the example travel backpack 20 is in the second configuration.

In the following discussion, the term "panel" will be used to refer to a flexible structure or member such as fabric or film sheets made of a variety of natural (e.g., leather, cotton) and synthetic (e.g. ballistic nylon fabric, polyester) materials. Such panels may be sewn to each other to define structures such as the main structure 30 and first and second mat structures 40 and 42 described herein. The panels may be formed of a single sheet of material, sheets made of blends of materials, and/or sheets of different materials sewn, glued, laminated, or otherwise combined. Further, for decorative or assembly reasons, what is referred to herein as a panel may further comprise a plurality of sub-panels edge joined by sewing or the like to form a single larger panel. On the first example travel backpack 20, the exact selection of materials, sizes, and configurations of the various panels as discussed below will typically be made based on considerations such as cost, aesthetics, and durability for a particular panel location and purpose.

Referring now specifically to FIG. 4, it can be seen that the example mat portion 24 comprises a first pad panel 60 and a second pad panel 62. In the example travel backpack 20, the main pad 26 is a single sheet of flexible, resilient foam material, and the first pad panel 60 and the second pad panel 62 are sewn together to enclose the entire main pad 26. With the main pad 26 formed of a single sheet of material, the main pad 26 is folded at first and second fold locations 26*a* and 26*b* when the first example travel backpack 20 is in the first configuration. The first fold location 26*a* of the example main pad 26 is arranged between the first and second sections 24*a* and 24*b* of the mat portion 24, and the second fold location 26*b* of the example main pad 26 is arranged between the second and third sections 24*b* and 24*c* of the mat portion 24. Alternatively, the main pad 26 may be formed in three distinct sections generally corresponding to the first, second, and third sections 24*a*, 24*b*, and 24*c* of the mat portion 24, in which case the first and second pad panels 60 and 62 may also be sewn together between each of the adjacent sections (e.g., at the fold locations 26*a* and 26*b* as depicted in FIG. 4).

Figure 1:
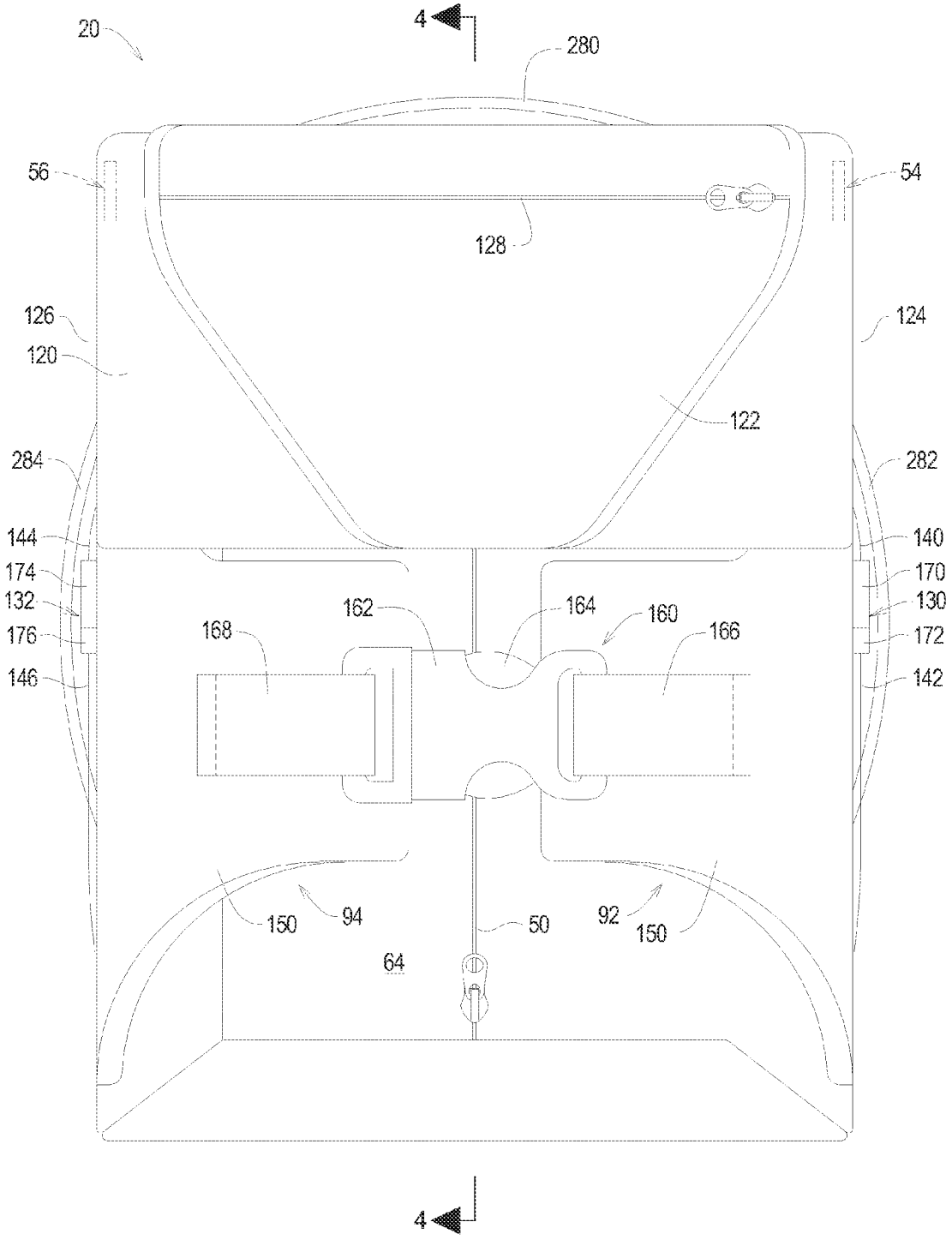
FIG. 1 is a rear elevation view of a first example travel backpack of the present invention in a first configuration.
Figure 7:
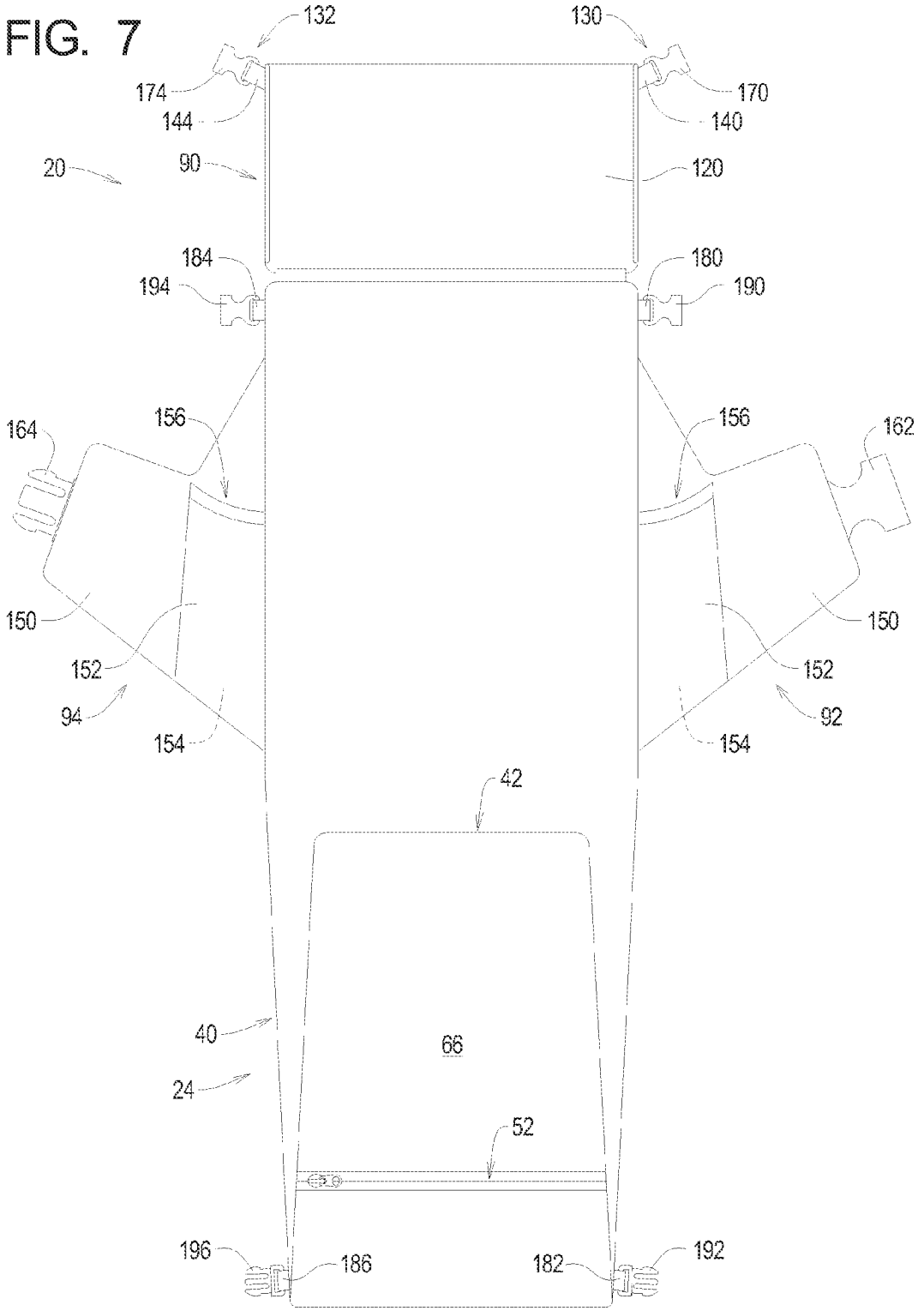
FIG. 7 is a rear elevation view of the part of the process depicted in FIG. 6.

FIG. 4 further shows that a first mat panel 64 is sewn to the first pad panel 60 to define the first mat chamber 44 and that a second mat panel 66 is sewn to the first pad panel 60 to define the second mat chamber 46. With this structure, the first mat zipper 50 is sewn to the first mat panel 64 (FIGS. 1 and 4), and the second mat zipper 52 is sewn to the second mat panel 66 (FIGS. 4 and 7). As shown in FIG. 1, the first mat zipper 50 extends along the longitudinal axis of the main pad 26, and FIG. 7 shows that the second mat zipper 52 extends perpendicular to the longitudinal axis of the main pad 26. Other locations and orientations of the first and second mat zippers 50 and 52 may be used for other example travel backpacks of the present invention.

The example main portion 22 is or may be a conventional backpack structure and will be described herein only to the extent helpful for a complete understanding of the first example travel backpack 20. The example main portion 22 comprises an inner panel 70, a bottom panel 72, a first side panel 74, a second side panel 76, and a top panel 78 forming a compartment structure. The example main portion further comprises a cover panel 80 and an outer panel 82, and a strap panel 84 defining a cover structure. The compartment structure of the example main portion 22 further comprises a bottom pad member 86 and a liner panel 88. The cover structure is secured to the compartment structure to define a main opening through which items may be inserted into the compartment structure. The main zipper 34 is arranged to allow the main opening to be accessed when unzipped and to prevent access to the main opening when zipped.

In the example travel backpack 20, first pad panel 60 is secured to and overlies the inner panel 70 of the main structure 30. Alternatively, the first pad panel 60 and the inner panel 70 may be the same panel member. In either case, a portion of the main pad 26 overlies the inner panel 70 in both the first and second configurations of the first example travel backpack 20.

The example main structure 30 further comprises a flap structure 90, first and second wing structures 92 and 94, and a strap system 96.

The example flap structure 90 comprises a flap inner panel 120, a flap outer panel 122, first and second flap side panels 124 and 126, and a flap zipper 128. The flap structure 90 is secured to the rest of the main structure 30 such that the flap structure 90 rotates between a first flap configuration (e.g., FIGS. 1-4) and second flap configurations (e.g., FIGS. 5-9). The example main structure 30 further comprises first and second flap fastener assemblies 130 and 132 to allow the flap structure 90 to be secured in the first flap configuration. In the example main structure 30, first, second, third, and fourth flap straps 140, 142, 144, and 146 are used to facilitate the use of the first and second flap fastener assemblies 130 and 132.

The example first and second wing structures 92 and 94 are mirror images of each other and will be discussed together. Each of the wing structures 92 and 94 comprises a wing main panel 150 and a wing pocket panel 152. The example wing structures 92 and 94 each define a wing pocket 154 accessed through a wing pocket opening 156. The example wing pockets 154 are designed to hold a water bottle or the like and thus are not zippered, but zippers may be used to allow the wing pocket openings 156 to be selectively opened and closed.

A wing fastener assembly 160 is provided to allow the first and second wing structures 92 and 94 to be secured together in a first wing configuration as shown in FIGS. 1 and 2. Uncoupling the wing fastener assembly 160 allows the first and second wing structures 92 and 94 to be rotated away from each other into a second wing configuration as shown in FIGS. 5-9. The example wing fastener assembly 160 comprises a first wing clip member 162 and a second wing clip member 164. In the example main structure 30, the first wing clip member 162 is attached to the first wing structure 92 by a first wing strap 166, and the second wing clip member 164 is attached to the second wing structure 94 by a second wing strap 168.

Referring for a moment back to the first and second fastener assemblies 130 and 132, FIG. 1 illustrates that the first fastener assembly 130 comprises a strap first female clip member 170 and a strap first male clip member 172 and that the second fastener assembly 132 comprises a strap second female clip member 174 and a strap second male clip member 176. The strap first female clip member 170 and the strap second female clip member 174 are secured to the flap structure 90 by the first and third flap straps 140 and 144, respectively. The strap first male clip member 172 and the strap second male clip member 176 are attached to the main structure 30 by the second and fourth flap straps 142 and 146, respectively.

As perhaps best shown in FIG. 7, the mat portion 24 further comprises first, second, third, and fourth mat strap members 180, 182, 184, and 186. FIG. 7 further illustrates that the first mat fastener assembly 54 comprises a first female mat clip member 190 and a first male clip member 192 and that the second mat fastener assembly 56 comprises a second female mat clip member 194 and a second male mat clip member 196. The first and third mat strap members 180 and 184 secure the first and second female mat clip members 190 and 194 relative to the main structure 30 adjacent to the flap structure 90. The second and fourth mat strap members 182 and 186 secure the first and second male mat clip members 192 and 196 to the first mat structure 40 adjacent to the second mat structure 42.

Figure 11:
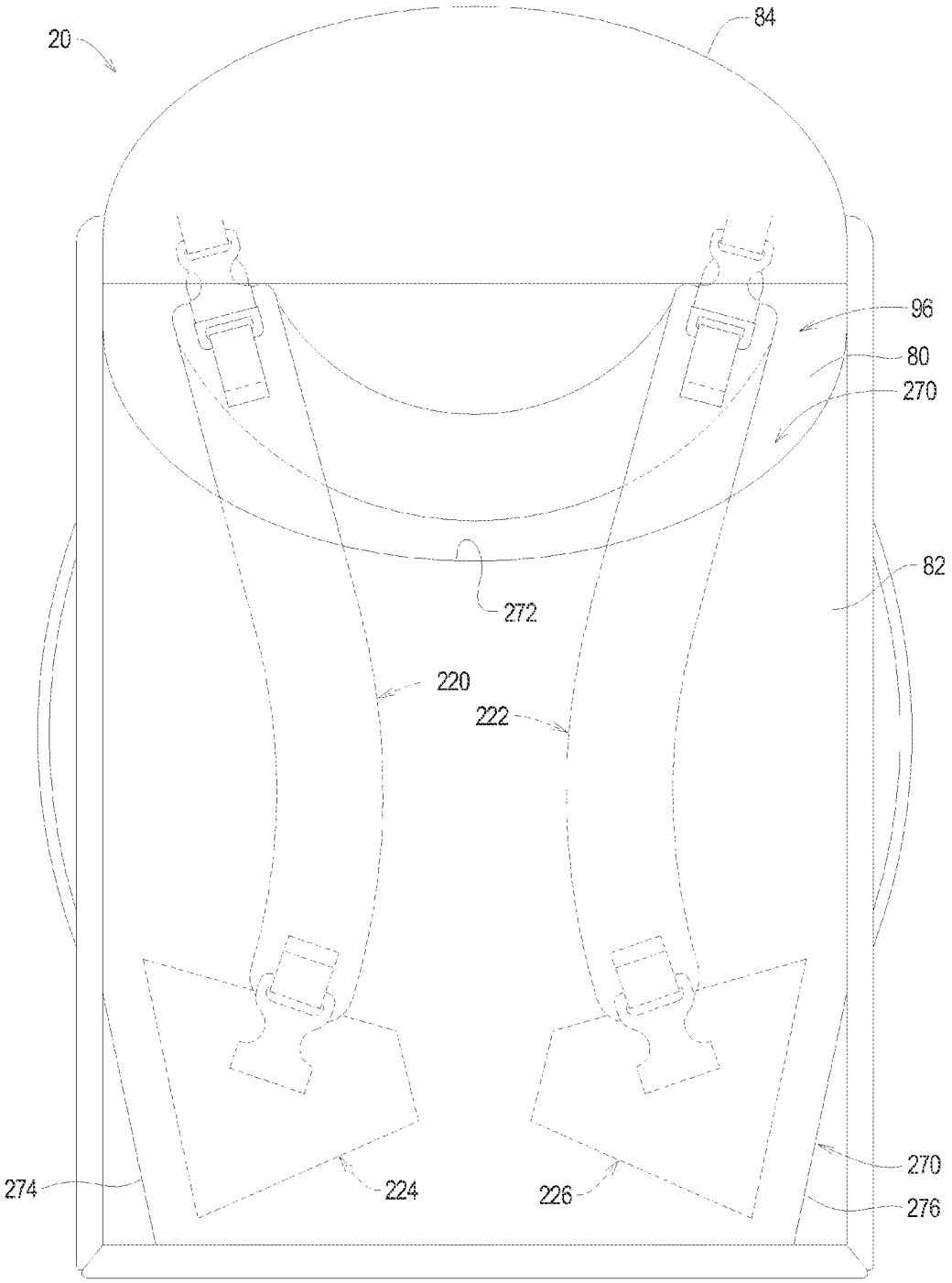
FIG. 11 is a front elevation view depicting a part of a first step of the process of converting a strap assembly of the first example travel back pack from a storage configuration into a use configuration.
Figure 12:
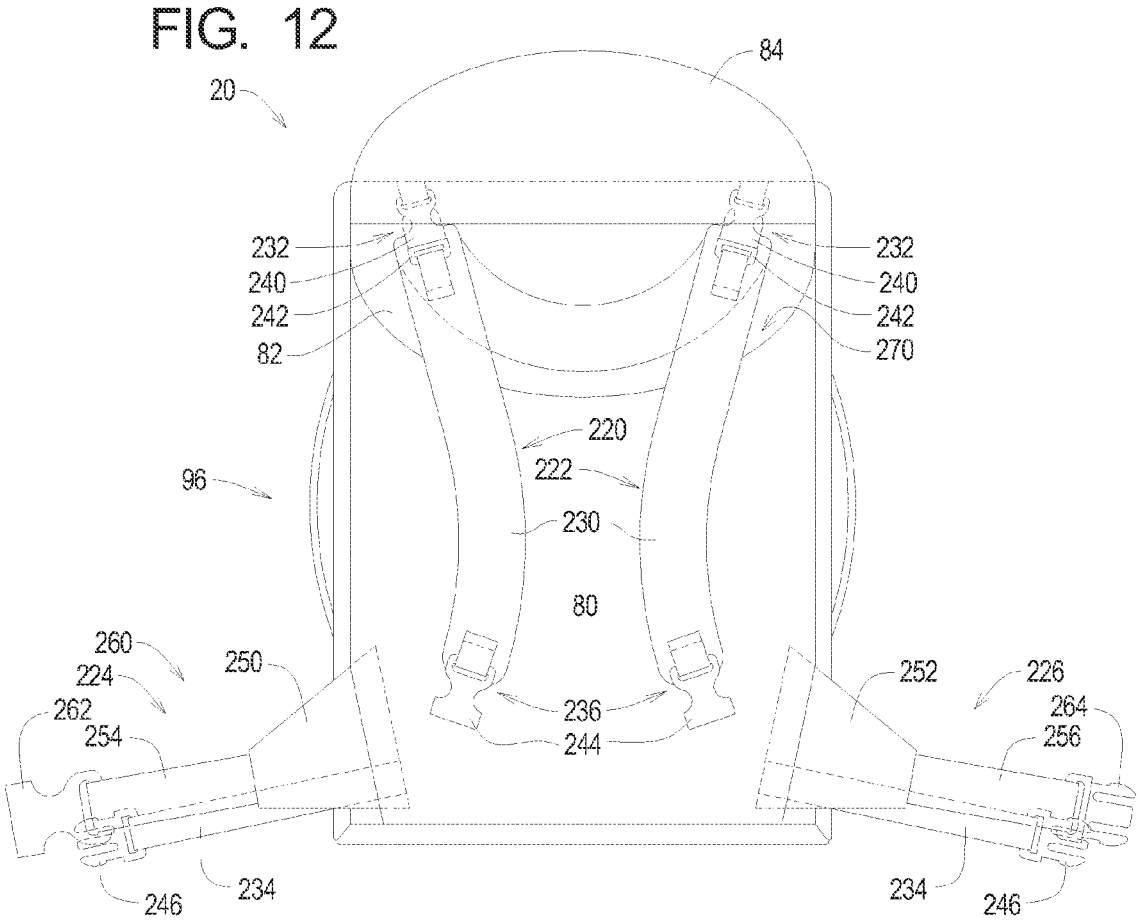
FIG. 12 is a front elevation view depicting a part of a second step of the process of converting the strap assembly of the first example travel back pack from the storage configuration into the use configuration.

FIGS. 3, 11, and 12 illustrate that the main structure 30 further comprises first and second shoulder strap assemblies 220 and 222 and first and second waist strap assemblies 224 and 226.

The example shoulder strap assemblies 220 and 222 are mirror images of each other and both comprise an upper strap 230, an upper fastener assembly 232, a lower strap 234, and an intermediate fastener assembly 236. The example upper fastener assemblies 232 each comprise an upper clip female member 240 and an upper clip male member 242. The example intermediate fastener assemblies 236 each similarly comprise an intermediate clip female member 244 and an intermediate clip male member 246.

The waist strap assemblies 224 and 226 comprise first and second waist panels 250 and 252 and first and second waist straps 254 and 256, respectively. A waist fastener assembly 260 is configured to allow the first and second waist straps 254 and 256 to be detachably attached around a wearer's waist. The example waist fastener assembly 260 comprises a waist clip female member 262 and a waist clip male member 264. The cover panel 80 and outer panel 82 define a strap chamber 270 having a top opening 272 and first and second strap openings 274 and 276.

The main portion 22 further comprises a top handle 280 and first and second side handles 282 and 284 configured to facilitate handling of the first example travel backpack 20.

When the mat portion 24 is folded as shown in FIGS. 1-4, the first example travel backpack 20 defines a compact form factor that facilitates carrying of the first example travel backpack 20. In this first configuration, the shoulder strap assemblies 250 and 252, waist straps 254 and 256, top handle 280, first side handle 282, and second side handle 284 may be used to carry the first example travel backpack 20. The main zipper 34 and first mat zipper 50 are accessible when the first example travel backpack 20 is in the first configuration. The second mat zipper 52 is not accessible when the first example travel backpack 20 is in the first configuration.

In the first configuration, the main pad 26 is in a folded configuration as shown in FIG. 4. The first and second mat clip assemblies 54 and 56 are secured to hold the mat portion 24 such that the main pad 26 is stored in the folded position relative to the main portion 22; with the main pad 26 in this folded position, the flap structure 90 overlaps the folded up mat portion 24 to maintain the first example travel backpack in the first configuration. Further, the first and second wing structures 92 and 94 are secured over the mat portion 24 using the wing clip assembly 160. The flap structure 90 and the first and second wing structures 92 and 94 thus stabilize the flap structure 90 in its compact form during carrying of the example first travel backpack 20 in its first configuration.

Figure 5:
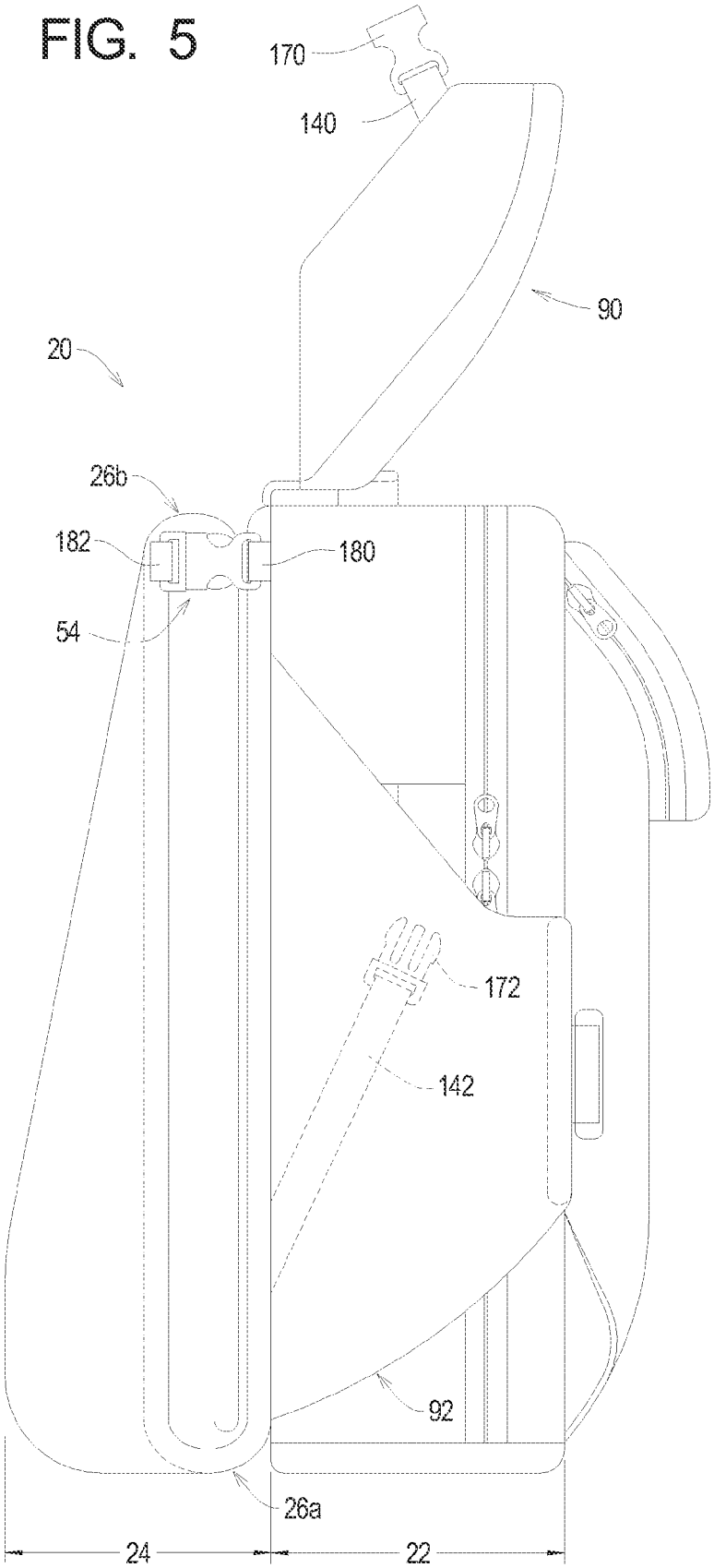
FIG. 5 is a side elevation view of part of a first step of a process of converting the first example travel backpack from the first configuration to a second configuration.
Figure 6:
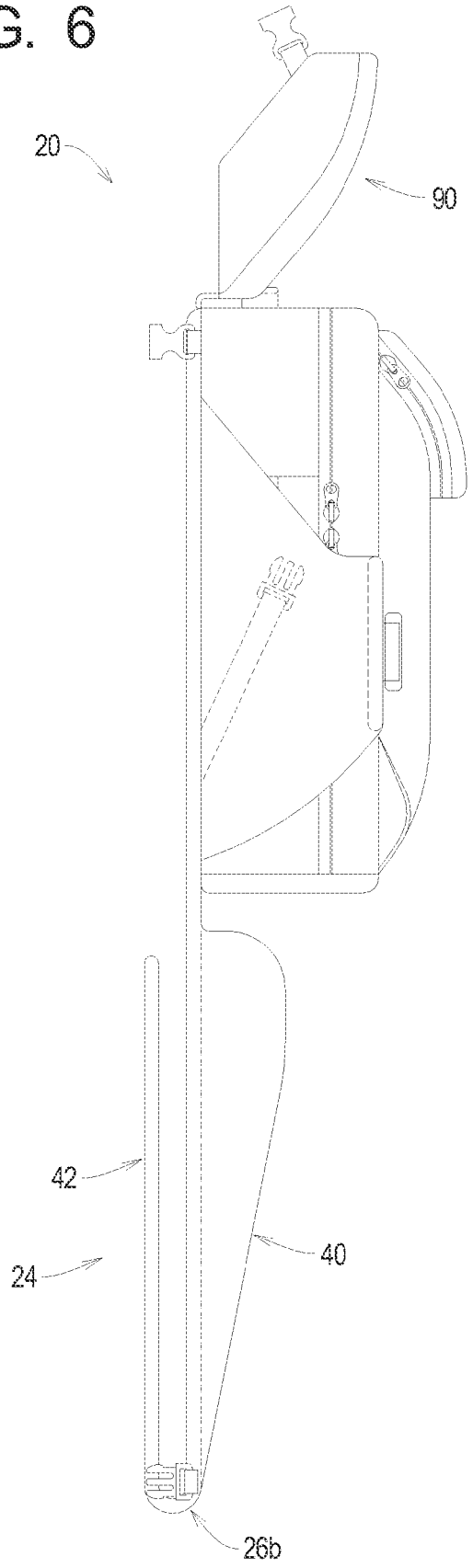
FIG. 6 is a side elevation view of part of a second step of the process of converting the first example travel backpack from the first configuration to the second configuration.

To unfold the main pad 26 and the mat portion 24 and thus place the first example travel backpack 20 in the second configuration, the first and second flap clip assemblies 130 and 132 are initially released to allow the example flap structure 90 to be rotated up and away from the mat portion 24 as perhaps best shown in FIG. 5. FIGS. 5-7 also show that the wing clip assembly 160 is released to allow the first and second wing structures 92 and 94 to be rotated away from the mat portion 24. The first and second mat clip assemblies 54 and 56 are then released to allow the mat portion 24 to be folded into an intermediate configuration as shown in FIGS. 6 and 7. In this intermediate position, the second mat zipper 52 is accessible as shown in FIG. 7.

As shown in FIGS. 8 and 9, the mat portion 24 is then further unfolded to move the mat portion 24 from the intermediate configuration into the second configuration. In the second configuration, the mat portion 24 defines a sleep surface 290. As should be apparent from a comparison of FIGS. 4 and 8, the main pad 26 is arranged under substantially the entire sleep surface 290. When the traveler 28 reclines on the sleep surface 290, the main pad 26 provides cushioning for the traveler 28. The first mat chamber 44 is sized and dimensioned to be filled with soft items (e.g., clothing) such that the first mat structure 40 comfortably supports the traveler between the main portion 22 and the second mat structure 42.

The mat portion 24 may be folded into the intermediate configuration and then into the folded configuration to return the first example travel backpack 20 to its first configuration. At this point, the first and second mat clip assemblies 54 and 56, the first and second flap clip assemblies 130 and 132, and the wing clip assembly 160 may be operated to secure the first example travel backpack 20 in its first configuration.

FIGS. 11 and 12 illustrate that the first and second shoulder strap assemblies 220 and 222 and first and second waist strap assemblies 224 and 226 may be stored within the strap chamber 260 when not needed (e.g., when the first example travel backpack 20 is stored in an overhead bin) and removed and connected when the first and second shoulder strap assemblies 220 and 222 and/or first and second waist strap assemblies 224 and 226 are used to carry the first example travel backpack 20.

What is claimed is:

1. A travel backpack comprising:

a main portion defining a main chamber for storing items;

a mat portion; and a main pad supported by the main portion and the mat portion such that the main pad extends through at least a portion of the main portion and through the mat portion; wherein the travel backpack is arranged in a first configuration in which the mat portion is folded and secured to the main portion to facilitate carrying of the travel backpack; and a second configuration in which the mat portion is unfolded to allow the travel backpack to be used as a sleep surface, where the main pad extends along the length of the sleep surface when the travel backpack is in the second configuration.

2. A travel backpack as recited in claim 1, in which the main pad is folded at first and second fold locations when the travel backpack is in the first configuration.

3. A travel backpack as recited in claim 2, in which:

the first fold location is arranged at a juncture of the main portion and the mat portion; and the second fold location is arranged within the mat portion.

4. A travel backpack as recited in claim 1, further comprising at least one fastener arranged to secure the mat portion to the main portion when the travel backpack is in the first configuration.

5. A travel backpack as recited in claim 1, in which the main portion defines first and second wing structures and further comprises a fastener to secure the wing structures around the folded mat portion when the travel backpack is in the first configuration.

6. A travel backpack as recited in claim 1, further comprising at least one fastener arranged to secure the mat portion to the main portion when the travel backpack is in the first configuration, where the main portion defines first and second wing structures and further comprises a fastener to secure the wing structures around the folded mat portion when the travel backpack is in the first configuration.

7. A travel backpack as recited in claim 1, in which:

the main portion defines first and second portions;

the mat portion is arranged against the first portion of the main portion when the travel backpack is in the first configuration; and the main portion further comprises first and second strap assemblies arranged adjacent to the second portion of the main portion.

8. A method of providing a travel backpack comprising the steps of:

providing a main portion defining a main chamber for storing items;

securing a mat portion to the main portion at a juncture;

securing a main pad to the main portion and the mat portion such that the main pad extends across the juncture; and folding the mat portion and securing the mat portion to the main portion to arrange the travel backpack in a first configuration to facilitate carrying of the travel backpack; and unfolding the mat portion to arrange the travel backpack in a second configuration to allow the travel backpack to be used as a sleep surface, where the main pad extends along the length of the sleep surface when the travel backpack is in the second configuration.

9. A method as recited in claim 8, in which the step of folding the mat portion comprises the step of folding the main pad at first and second fold locations.

10. A method as recited in claim 9, in which:

the first fold location is arranged at the juncture of the main portion and the mat portion; and the second fold location is arranged within the mat portion.

11. A method as recited in claim 8, further comprising the step of securing the mat portion to the main portion when the travel backpack is in the first configuration.

12. A method as recited in claim 8, in which the step of providing the main portion comprises the step of providing first and second wing structures, the method further comprising the step of securing the wing structures around the folded mat portion when the travel backpack is in the first configuration.

13. A method as recited in claim 8, in which the step of providing the main portion comprises the step of providing first and second wing structures, further comprising the steps of securing the mat portion to the main portion and securing the wing structures around the folded mat portion when the travel backpack is in the first configuration.

14. A method as recited in claim 1, further comprising the steps of:

arranging the mat portion against a first portion of the main portion when the travel backpack is in the first configuration; and arranging first and second strap assemblies of the main portion adjacent to a second portion of the main portion.

* * * * *